United States Patent [19]

Steberger

[11] Patent Number: 5,018,230

[45] Date of Patent: May 28, 1991

[54] SANDLESS BEACH BLANKETS

[76] Inventor: Paul Steberger, 961 Treetops, Wharton, N.J. 07885

[21] Appl. No.: 508,165

[22] Filed: Apr. 12, 1990

[51] Int. Cl.[5] ..... A47G 9/06

[52] U.S. Cl. ..... 5/420; 428/109; 428/255

[58] Field of Search ..... 5/417–420, 5/482, 500, 502; 428/109, 255

[56] References Cited

U.S. PATENT DOCUMENTS

| | | | |
|---|---|---|---|
| 3,605,166 | 9/1971 | Chen | 428/116 |
| 4,278,719 | 7/1981 | Sarnecki | 5/420 |
| 4,296,855 | 10/1981 | Blalock | 428/255 |
| 4,778,706 | 10/1988 | Katz | 428/109 |
| 4,903,356 | 2/1990 | Morisaki | 5/420 |

*Primary Examiner*—Alexander Grosz
*Attorney, Agent, or Firm*—Robert J. Ferb

[57] ABSTRACT

A Sandless Beach Towel or Blanket which is composed of an upper and lower layer joined at eight points equally spaced over their surfaces. The upper layer is made of an open weave material preferably of cotton and the lower layer is made of a tightly woven material preferably cotton. Sand which is brought on to the top surface of the blanket passes through the openings in the open weave material in the upper layer and accumulates between the upper and lower layers to prevent the sand from coming into contact with the person sitting or laying on the blanket. The blanket can be shaken as a unit and the sand that has accumulated between the upper and lower layers readily dislodges and falls out from between the layers. Cleaning can also be accomplished by separating the layers and brushing or shaking off the sand where it has accumulated. In an alternative embodiment the upper and lower layers are attached to each other along their perimeter.

25 Claims, 2 Drawing Sheets

FIG. 1b
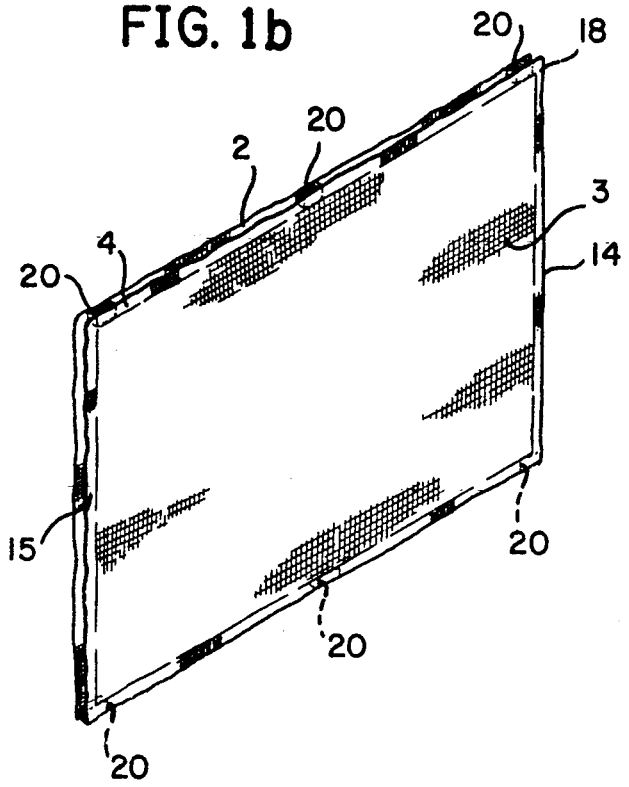
FIG. 1a
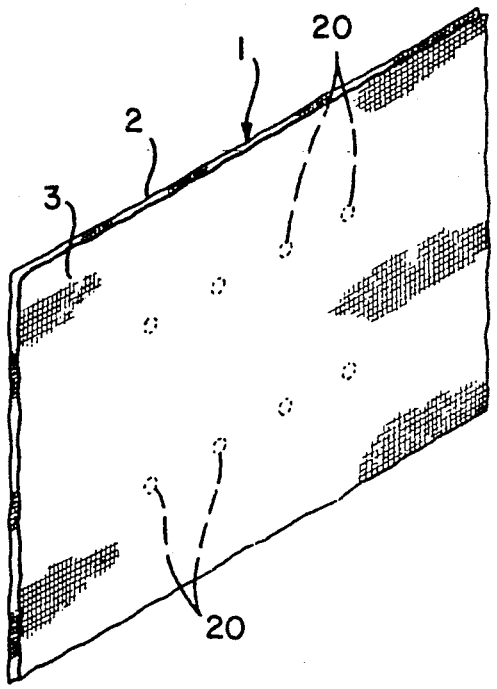
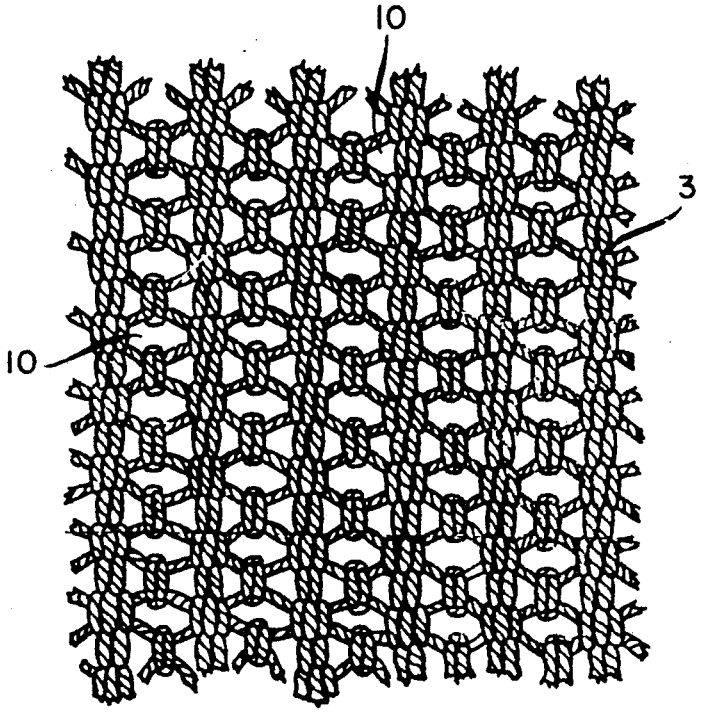
FIG. 2

SANDLESS BEACH BLANKETS

BACKGROUND OF INVENTION

This invention relates generally to the field of beach towels and beach blankets and more particularly such blanket and towels used on sandy beaches.

Sandy beaches pose a particularly difficult environment for maintaining a comfortable location for sitting or laying on the beach after swimming or other activities. This is so because the towels or blankets are periodically subjected to wetting with water from bathing and the accumulation of sand, either blown or tracked on to the blanket or towel.

Once sand is carried on to the conventional beach towel or blanket, it remains oin the top surface causing discomfort. This sand also adheres to the skin and bathing suits of persons sitting or laying down on the portion of the blanket or towel covered by this surface sand.

While the quantity of the surface sand that accumulates on these blankets and towels is not particularly large, because of its location, it causes a disproportionate amount of discomfort to the bathers. Removal of this sand requires the blanket to be periodically lifted from the sand and shaken clean. Typically, when this shaking out process takes place, especially on a crowded beach, sand is scattered and carried onto other blankets and other bathers in the vicinity. The amount of sand that is dislodged in the shaking process is often substantially more than that accumulated on the top of the blanket or towel, because the towels or blankets are wet and sand has adhered to the underside. This extra sand is also shaken loose and scattered in the wind when the blanket is shaken.

This problem of sand accumulation presents bathers with the unhappy choice of tolerating the sandy blanket or the risk of exposing neighboring bathers to flying sand from the blanket cleaning process.

Terrycloth made preferably of cotton is a widely used material for such blankets and towels, and while it provides advantages such as comfort and moisture absorption, it has the tendency to retain sand particles, especially if the towel or blanket is moist. Due to this tendency to hold sand, terrycloth requires that a vigorous effort be made to clean the towel or blanket, and thereby causing sand to be scattered fairly widely during the cleaning process resulting in an increased possibility that sand will be thrown on to adjacent blankets and/or bathers.

The present art embodied in terrycloth blankets and towels, has certain obviously useful and beneficial features, but does not fully meet the needs of bathers.

SUMMARY OF INVENTION

It is an object of this invention to provide a blanket or beach towel with the moisture absorbency and comfort comparable to the existing towels and blankets with the additional capacity to protect the user from contact with sand.

It is a further objective of the present invention to provide a blanket which is made up of an upper and lower layer. The upper layer, which is made of an open weave material, is designed to permit sand that impinges on the top surface to pass through the openings in the upper layer so that this sand will not come in contact with the person sitting or lying on the blanket.

It is a further object of the present invention to provide a lower layer which is comprised of a tightly woven material that prevents sand beneath the blanket from passing through the blanket and coming into contact with the user.

It is a further object of this invention to provide a beach blanket which facilitates the removal of sand that passes through the upper layer. In the preferred embodiment, the upper and lower layers are attached at eight points spaced uniformly over the blanket, leaving the edges open so that the sand will drop out when the blanket is shaken.

It is a further object of this invention to provide a blanket that holds sand accumulated between the upper and lower layers so that when the blanket is shaken the accumulated sand tends to fall to the lowest edge of the blanket near the surface of the ground to minimize dispersion of the sand from the blanket during the cleaning process.

It is a further object of this invention, in an alternative embodiment, to provide a blanket with readily separable upper and lower layers to permit cleaning of the sand accumulating between the upper and lower layers of the blanket. Cleaning is accomplished by separating the layers and then cleaning off the accumulated sand by conventional means such as shaking out the blanket or by merely brushing the sand off the lower layer. After the sand is removed the layers are reattached to each other. It is also an object of this invention to facilitate cleaning by separating the upper and lower layers and washing them by conventional means.

It is further object of this invention to provide a blanket which will dry more readily than a thicker single layer of material. This accelerated drying is accomplished by virtue of the design incorporating its two distinct upper and lower layers which allows air to circulate and also allow wind and sun to reach the lower layer through the plurality of openings created by the open weave of the upper layer.

It is a further object of the present invention to provide a blanket that can be used as two separate blankets or towels by merely separating the upper and lower layers in accordance with this invention.

It is also an object of the present invention to provide a beach towel or blanket to which sand does not adhere, unlike terrycloth type materials with small looped thread type structures, by using an upper layer with an open weave material and a lower layer with a tight weave material neither of which incorporate such sand catching loops.

This invention, embodied in either a beach towel or beach blanket comprised of separable upper and lower layers, is particularly useful on sandy beaches. The layers are preferably made of 100% cotton or other moisture absorbent materials. In the preferred embodiment the upper and lower layers are fixedly or removably attached to each other, by conventional means such as sewing, snaps, buttons, hook and loop type tabs or similar fastening means, at eight points uniformly arrayed between the layers. More or fewer fastening points may also be used in accordance with this invention to accommodate various sizes and material weights as may be desirable. In an alternative embodiment the upper and lower layers are attached to each other along their outer perimeter by conventional fastening means such as buttons, hook and loop types strips, snaps, zippers or similar fastening devices.

The lower layer, which comes into contact with sand on the beach, is made from a tight weave material having a weigth of 9.2 ounces per yard in the preferred embodiment. However, material in the range of 5.2 ounces to 8.5 ounces per yard are also satisfactory and material somewhat over 9.2 ounces per yard or somewhat less than 5.2 ounces per yard may also be used.

In the preferred embodiment the upper layer is made from an open weave cotton such as that made by Beacon Manufacturing Company having a weight of 9.2 ounces per yard. However, similar open weave materials in the range of 5.0 ounces per yard to 8.5 ounces per yard are also satisfactory and material somewhat over 9.2 ounces per yard or somewhat less than 5.2 ounces per yard may also be used. In addition, in the preferred embodiment the upper layer is woven in a Leno or Mock Leno pattern with approximately twenty to forty openings per square inch in the material. Other weave patterns which provide a similar range of openings are also satisfactory as well as weave patterns with somewhat more or fewer openings. In the preferred embodiment the lower layer is woven in a plain balanced weave consisting of yarn size 26 to 34 consisting of approximately 130 threads per square inch with a range of weight from approximately 5.2 ounces per yard to 9.2 ounces per yard.

DESCRIPTION OF THE DRAWINGS

FIG. 1*a* is an isometric view of the Sandless Blanket.

FIG. 1*b* is an isometric view of an alternative embodiment of the Sandless Blanket.

FIG. 2 is a detail showing the open weave of the upper layer.

DETAILED DESCRIPTION OF THE INVENTION

This invention as shown in FIG. 1*a* depicts the preferred embodiment of blanket 1, upper layer 3 being deposed toward the viewer and fastening points 20 arrayed uniformly over the area of blanket 1.

Figure 3B:
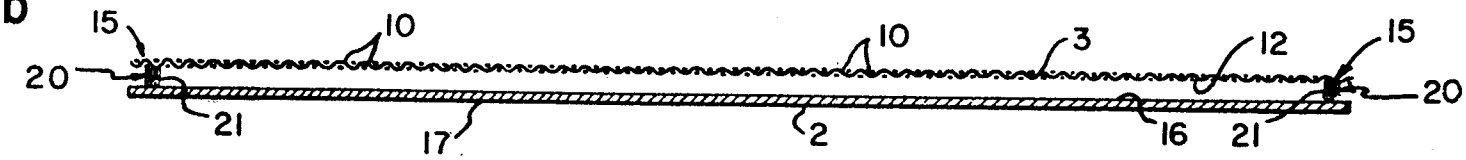
FIG. 3*b* is a cross-section showing the upper layer, the fastening means and the lower layer in an alternative embodiment.
Figure 3A:
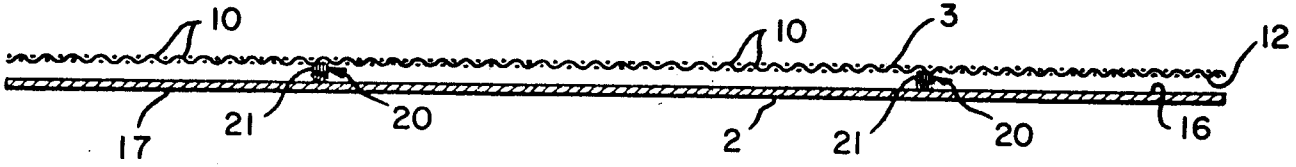
FIG. 3*a* is a cross-section showing the upper layer, the fastening means and the lower layer.

This invention as shown in FIG. 1*b* depicts an alternative embodiment of blanket 1 comprised of lower layer 2 and upper layer 3 which are removably attached to each other along perimeter 15. In both the preferred embodiment and in the alternative embodiment upper layer 3 as shown in FIG. 2 contains a plurality of openings 10 which form an open passage way between top side 11 of upper layer 3 to bottom side 12 of upper layer 3 as shown in FIG. 3*a* and 3*b*. In the preferred embodiment shown in FIG. 3*a* top layer 3 is attached to bottom layer bottom layer 2 at connecting points 20 by fastening means 21. In the preferred embodiment connecting points 20 are uniformly spaced over the surface of blanket 1 as shown as FIG. 4. Fastening means 21 such as hook and loop type tabs are attached to underside 12 of top layer 3 and connection points 20 to provide for attachment to lower layer 2 and coincident connecting point 20 located on the top surface 16 of lower layer 2. Blanket 1 in the size range of approximately 30 by 50 inches to approximately 80 by 80 inches incorporates attachment points 20 located uniformly over the surface of blanket 1.

In the alternative embodiment as shown in FIG. 3*b* upper layer 3 has border 4 around perimeter 15 which is devoid of any openings 10. Fastening means 20 such as a hook and loop type fastening are attached to underside 12 of upper layer 3 along border 4 to provide for attachment to lower layer 2 along perimeter 15 with a cooperating hook and loop type strip 21 attached by conventional means to the perimeter of lower layer 2. In this alternative embodiment, border 4 is approximately one-half inch wide however wider or narrower borders or upper layers without borders are also within the contemplation of this invention.

Figure 4A:
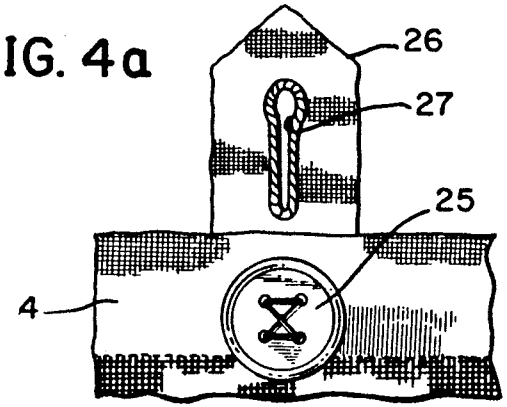
FIG. 4*a* shows a button and flap attachment between the upper and lower layers.
Figure 4:
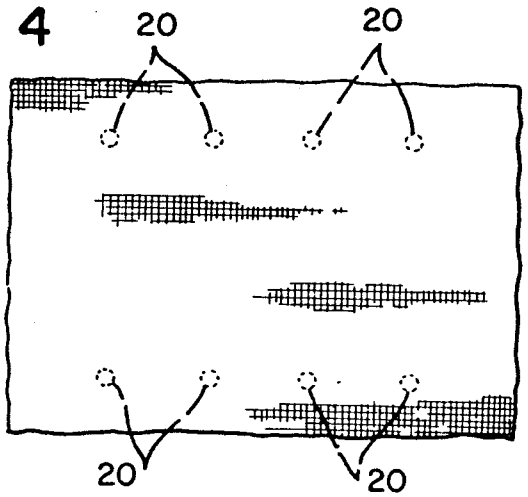
FIG. 4 shows distribution of the fastening means on the upper layer of the preferred embodiment.

FIG. 4*a* illustrates an alternative means of fastening the upper and lower layers together. Flap 26 containing button hole 27 is attached to lower layer 2, which in this figure is concealed under border 4 of upper layer 3. Button 25 is attached to upper layer 3 in border 4 along perimeter 15. Attachment of lower layer 2 to upper layer 3 is accomplished by folding flap 26 over button 25 and inserting button 25 through button hole 27.

In the preferred embodiment the Sandless Blanket or Towel is utilized in the following manner. Blanket 1 is placed on your sandy beach with bottom 17 of lower layer 2 in contact with the sand. Sand carried on to top side 11 of upper layer 3 passes through the plurality of opening 10 which communicate through sheet 3. This sand accumulates on top side 16 of lower layer 2 thus substantially removing the sand from upper layer 3 of blanket 1. This substantial removal of sand minimizes any content for the person sitting or lying on top side 11 of blanket 1. At such time as it may be desirable to remove sand which has accumulated between bottom side 12 and top side 16 from blanket 1, blanket 1 is lifted from the sand and shaken. Sand which has accumulated between bottom side 12 and top side 16, when shaken loose, falls by gravity to the edge of the blanket closest to the sand thereby resulting in the elimination of the accumulated sand from blanket 1. Since upper layer 3 is attached by connecting points 20 to lower layer 2 when blanket 1 is shaken upper layer 3 and lower layer 2 move as a unit during the shaking process and minimize the amount of loosened sand dispersed into the air.

An alternative but less preferable method of cleaning 10 from blanket 1 would be to physically detach upper 3 layer from lower 2 layer by disconnecting the fasteners and shaking each layer in a conventional manner to dislodge accumulated sand.

In addition to connecting points 20 being located uniformly across the surface of blanket 1, connecting points 20 can also be spaced uniformly around and located on perimeter 15 of blanket 1.

In the alternative embodiment, the Sandless Blanket or Towel is utilized in the same manner as the preferred embodiment. The removal of sand from the alternative embodiment in accomplished as follows:

As such time as it may be desirable to remove sand which has accumulated between bottom side 12 and top side 16 from blanket 1, upper layer 3 is separated from bottom layer 2 by pulling apart hook and loop type fasteners 20, 21 along perimeter 15 and the sand accumulating on top side 16 of lower layer 2 is then brushed off. As an alternative cleaning method lower layer 2 can be lifted and shaken in a conventional manner to remove accumulated sand. Any residual sand that may have clung to or accumulated on upper layer 3 can also be dislodged by shaking the sand loose. An alternative method of removing sand from the alternative embodiment shown in FIG. 1*b* the separation of top layer 3 from bottom layer 2 along only 1 edge of blanket 1. Blanket 1 would then be lifted along the edge opposite to that opened and shaken thus directing the sand between upper layer 3 and lower layer 2 by shaking in gravity towards the open edge which is located nearest to the ground during the shaking process.

From the foregoing description it can be seen that this invention affords substantial advantages over conventional art in its ability to conduct sand away from top surface 11 of blanket 1 to minimize contact of bathers and others with sand.

While the present invention is primarily intended for use on sandy beaches, it is understood that any application or use in which it is desirable to remove gritty or granular material from the surface of a blanket or towel upon which children or adults may sit, lay, crawl, or otherwise utilize is within the contemplation of this invention. The two layer structure and openings through the upper layer of the blanket or towel provide the means to conduct any such gritty or granular material away from contact with users.

It is also futher understood that the preceding description is illustrative of the preferred embodiment and an alternative embodiment and various changes in the size, shape, materials, fasteners as well as the details of the preferred embodiment or the alternative embodiment may be made without departing from the of scope of the invention as described and claimed herein.

It is also contemplated that the upper and lower layers need not be physically attached to each other, nor need they be attached at the points described in the preferred or alternative embodiment but may be removably or fixedly attached to each other at other points without departing from the of scope of the invention as described and claimed herein.

I claim:

1. A blanket or towel of a size adapted to support a substantial portion of a seated or laying user, primarily intended for use on sandy surfaces comprised of:

a lower layer, and an upper separate and unattached fabric layer which is placed on top of said lower layer and which said upper layer contains a plurality of openings of a size substantially larger than grains of sand, which penetrate from the upper surface through said upper layer through to the upper surface of said lower layer whereby sand which is brought on to the top surface of the blanket or towel passes through the openings in the upper layer and accumulates between the upper and lower layers to prevent sand from coming into contact with the user.

2. A blanket or towel as described in claim 1 wherein said upper layer is removable attached by conventional fastening means to said lower layer at at least two points arrayed on the lower surface of said upper layer and the upper surface of said lower layer.

3. A blanket or towel as described in claim 2 wherein the upper and lower layers are made of water absorbent material.

4. A blanket or towel as described in claim 3 wherein the upper and lower layers are made of woven material.

5. A blanket or towel as described in claim 4 wherein the upper and lower layers are made of cotton.

6. A blanket or towel as described in claim 5 wherein the upper layer is woven in a Leno pattern with 20 to 40 openings per square inch with a range of weight from approximately 5.25 ounces per yard to 9.2 ounces per yard and said lower layer is woven in a plain balanced weave consisting of yarn size 26 to 34 consisting of approximately 130 threads per square inch with a range of weight from approximately 5.2 ounces per yard to 9.2 ounces per yard.

7. A blanket or towel as described in claim 5 wherein the upper layer is woven in a Mock Leno pattern with 20 to 40 openings per square inch with a range of weight from approximately 5.2 ounces per yard to 9.2 ounces per yard and said lower yard is woven in a plain balanced weave consisting of yarn size 26 to 34 consisting of approximately 130 threads per square inch with a range of weight from approximately 5.2 ounces per yard to 9.2 ounces per yard.

8. A blanket or towel as described in claim 1 wherein the upper and lower layers are made of water absorbent material.

9. A blanket or towel as described in claim 8 wherein the upper and lower layers are made of woven material.

10. A blanket or towel as described in claim 9 wherein the upper and lower layers are made of cotton.

11. A blanket or towel as described in claim 10 wherein the upper layer is woven in a Leno pattern with 20 to 40 openings per square inch with a range of weight from approximately 5.2 ounces per yard to 9.2 ounces per yard and said lower layer is woven in a plain balanced weave consisting of yarn size 26 to 34 consisting of approximately 130 threads per square inch with a range of weight from 5.2 approximately ounces per yard to 9.2 ounces per yard.

12. A blanket or towel as described in claim 10 wherein the upper layer is woven in Mock Leno pattern with 20 to 40 openings per square inch with a range of weight from approximately 5.2 ounces per yard to 9.2 ounces per yard and said lower layer is woven in a plain balanced weave consisting of yarn size 26 to 34 consisting of approximately 130 threads per square inch with a range of weight from approximately 5.2 ounces per yard to 9.2 ounces per yard.

13. A blanket or towel as described in claim 1 wherein said upper layer is removably attached to said lower layer by conventional fastening means.

14. A blanket or towel as described in claim 13 wherein said upper and lower layers are made of water absorbent material.

15. A blanket or towel as described in claim 14 wherein said upper and lower layers are made of woven material.

16. A blanket or towel as described in claim 15 wherein the upper and lower layers are made of cotton.

17. A blanket or towel as described in claim 16 wherein the upper layer is woven in a Leno pattern with 20 to 40 openings per square inch with a range of weight from approximately 5.2 ounces per yard to 9.2 ounces per yard and said lower layer is woven in a plain balanced weave consisting of yarn size 26 to 34 consisting of approximately 130 threads per square inch with a range of weight from approximately 5.2 ounces per yard to 9.2 ounces per yard.

18. A blanket or towel as described in claim 16 wherein the upper layer is woven in a Mock Leno pattern with 20 to 40 openings per square inch with a range of weight from approximately 5.2 ounces per yard to 9.2 ounces per yard and said lower layer is woven in plain balanced weave consisting of yarn size 26 to 34 consisting of approximately 130 threads per square inch with a range of weight from approximately 5.2 ounces per yard to 9.2 ounces per yard.

19. A blanket or towel as described in claim 1 wherein said upper layer is removably attached to said lower layer along their respective perimeters by conventional fastening means.

20. A blanket or towel as described in claim 19 wherein said upper layer has a border around its perimeter which is free from openings through the material.

21. A blanket or towel as described in claim 20 wherein the upper and lower layers are made of water absorbent material.

22. A blanket or towel as described in claim 21 wherein the upper and lower layers are made of woven material.

23. A blanket or towel as described in claim 22 wherein the upper and lower layers are made of cotton.

24. A blanket or towel as described in claim 23 wherein the upper layer is woven in a Leno pattern with 20 to 40 openings per square inch with a range of weight from approximately 5.2 ounces per yard to 9.2 ounces per yard and said lower layer is woven in a plain balanced weave consisting of yarn size 26 to 34 consisting of approximately 130 threads per square inch with a range of weight from approximately 5.2 ounces per yard to 9.2 ounces per yard.

25. A blanket or towel as described in claim 23 wherein the upper layer is woven in a Mock Leno pattern with 20 to 40 openings per square inch with a range of weight from approximately 5.2 ounces per yard to 9.2 ounces per yard and said lower layer is woven in a plain balanced weave consisting of yarn size 26 to 34 consisting of approximately 130 threads per square inch with a range of weight from approximately 5.2 ounces per yard to 9.2 ounces per yard.

* * * * *